US005596311A

United States Patent [19]

Bess et al.

[11] Patent Number: 5,596,311

[45] Date of Patent: Jan. 21, 1997

[54] METHOD AND APPARATUS FOR DRIVING A SELF-RESONANT ACOUSTIC TRANSDUCER

[75] Inventors: Emery L. Bess, Nampa; Harry S. Erskine, Boise, both of Id.

[73] Assignee: Preco, Inc., Boise, Id.

[21] Appl. No.: 447,715

[22] Filed: May 23, 1995

[51] Int. Cl.[6] ..... G08B 3/10

[52] U.S. Cl. ..... 340/384.7; 340/388.4; 340/392.3; 340/398.2; 340/392.5; 331/116 R; 331/154; 331/155; 381/96

[58] Field of Search ..... 331/116 R, 154, 331/155; 340/384.7, 388.4, 392.3, 398.2, 392.5; 381/96, 59

[56] References Cited

U.S. PATENT DOCUMENTS

| | | | |
|---|---|---|---|
| 3,743,868 | 7/1973 | Kawada et al. | 310/8.1 |
| 3,967,143 | 6/1976 | Watanabe et al. | 310/8.1 |
| 4,195,284 | 3/1980 | Hampshire et al. | 340/384 |
| 4,275,388 | 6/1981 | Hornung | 340/384 |
| 4,376,255 | 3/1983 | Kleinschmidt | 310/317 |
| 4,603,317 | 7/1986 | Gailbreath et al. | 340/70 |
| 5,049,853 | 9/1991 | Yoon | 340/388 |
| 5,179,511 | 1/1993 | Troyk et al. | 363/97 |
| 5,181,019 | 1/1993 | Gottlieb et al. | 340/474 |
| 5,245,296 | 9/1993 | Miller et al. | 330/85 |
| 5,387,875 | 2/1995 | Tateno | 330/10 |

*Primary Examiner*—Jeffery Hofsass
*Assistant Examiner*—Daryl C. Pope
*Attorney, Agent, or Firm*—Limbach & Limbach L.L.P.

[57] ABSTRACT

A method and system employing a feedback signal indicative of monitored motion of an electro-mechanical acoustic transducer to generate one or both of a control signal for driving the transducer at its natural resonance frequency, and a warning signal indicating that the transducer is not vibrating at a frequency within a selected frequency range. In preferred embodiments, the transducer is a voice coil loudspeaker mounted in or on a vehicle. In other preferred embodiments, the electro-mechanical transducer is driven by an initial electrical pulse followed by a sequence of electrical pulses. A feedback signal indicative of monitored motion of a moving portion of the transducer is generated. Each pulse (following the initial pulse) is applied at a time (determined by the feedback signal) so as to drive the transducer at its actual natural resonance frequency. Some embodiments monitor the peak velocity (rather than displacement) of a driven electro-mechanical transducer, process the monitored peak velocity signal to generate feedback indicative of actual radiated energy from the transducer, and generate from the feedback signal one or both of a control signal for driving the transducer in a desired manner and a warning signal indicating that the transducer has not radiated a selected minimum amount of energy.

18 Claims, 3 Drawing Sheets

METHOD AND APPARATUS FOR DRIVING A SELF-RESONANT ACOUSTIC TRANSDUCER

FIELD OF THE INVENTION

The invention pertains to methods and circuitry for driving an electro-mechanical acoustic transducer at its (possibly time-varying) natural resonance frequency, using a feedback signal indicative of monitored motion of the transducer. In preferred embodiments, the acoustic transducer is a voice coil loudspeaker mounted in a vehicle (a vehicle alarm), and the feedback signal is indicative of voltage across the voice coil as the loudspeaker emits sound.

BACKGROUND OF THE INVENTION

Many mechanical and electrical systems have a natural resonance frequency, which can be observed by monitoring the rate at which energy supplied thereto is alternately converted from one form to another. For example, in response to an impulsive force, a tuning fork converts potential energy to kinetic energy at its natural resonance frequency (sometimes referred to herein as its "natural" frequency) thereby emitting acoustic radiation whose fundamental frequency component is the "natural" frequency.

Real systems of this type can be modeled as a natural resonant circuit, subject to losses which remove energy from the natural resonant circuit. These losses can be in the form of heat (as in the case of high hysteresis materials) or radiation (as in the case of acoustic radiation from a vibrating system immersed an air or water). If enough energy is dissipated from the system, no resonance will occur (as when the system is critically damped).

A "self resonant" system includes a feedback mechanism which reintroduces power (in proper phase and frequency) to maintain the system in resonance at its natural frequency, while losses remove power from the system.

It is known to monitor the output of some types of self resonant systems and to use such a monitored signal as feedback to control generation of a driving signal for maintaining the system in resonance at its natural frequency. For example, U.S. Pat. No. 4,275,388 (issued Jun. 23, 1981) discloses a piezoelectric alarm system in which output power is periodically measured (by periodically measuring displacement of the piezoelectric transducer in response to a swept driving signal). The measured output signals are employed to update the frequency of a driving signal, in an effort to maintain the driven transducer in resonance.

It is also known to drive a transducer with sharp-edged voltage pulses, by predeflecting the transducer with an initial one of the pulses, and then applying additional pulses at the rate of one pulse for each assumed (not measured) natural resonance period of the transducer. For example, U.S. Pat. No. 4,376,255 discloses a piezoelectric ultrasonic transducer which is driven by an initial pulse followed by a sequence of pulses. The pulses in the sequence are applied at the rate of one for each assumed natural resonance period of the transducer, but the system does not include a feedback means for measuring the transducer's response to the driving pulses and processing the measured signal to determine the transducer's actual natural resonance frequency.

However, until the present invention it was not known how efficiently to monitor the motion of a driven electro-mechanical acoustic transducer and use the monitored motion signal as feedback to control the driving means to keep the transducer vibrating at its natural resonance frequency. Nor was it known to generate a warning signal when such monitored motion signal indicates that the transducer is not vibrating at a frequency within a selected frequency range. Nor was it known to monitor the peak velocity of such a driven electro-mechanical acoustic transducer, to process the monitored velocity signal to generate a feedback signal indicative of actual radiated energy, and to generate from the feedback signal one or both of a control signal (for driving the transducer in a desired manner) and a warning signal indicating that the transducer has not radiated a selected minimum amount of energy.

SUMMARY OF THE INVENTION

In preferred embodiments, the invention is a method and system for driving an electro-mechanical acoustic transducer at its natural resonance frequency. Because it is contemplated that the natural resonance frequency is initially unknown (and can be time-varying), the invention employs a feedback signal indicative of monitored motion of the transducer (where such monitored motion is indicative of the natural resonance frequency). In some embodiments, the acoustic transducer is a voice coil loudspeaker. In preferred embodiments, the acoustic transducer is a voice coil loudspeaker mounted in or on a vehicle (i.e., a vehicle alarm).

In preferred embodiments, an electro-mechanical transducer is driven by an initial electrical (voltage or current) pulse followed by a sequence of electrical pulses. A feedback signal indicative of monitored motion of a moving portion (e.g., a voice coil) of the transducer is generated. Each pulse (following the initial pulse) is applied at a time (determined by processing the feedback signal) so that the transducer is driven at its actual natural resonance frequency. In some preferred embodiments, the feedback signal indicates each positive-going zero crossing (except those occurring within predetermined time "windows") of the voltage across the moving transducer. Preferably, the feedback signal generation circuitry establishes such a time "window" during a period (in which spurious voltage spikes across the transducer are expected) immediately after assertion of each driving pulse to the transducer.

Other preferred embodiments of the invention generate a warning signal when the feedback signal (indicative of monitored transducer motion) indicates that the transducer is not vibrating at a frequency within a selected frequency range. This warning signal can be generated in addition to (or instead of) a control signal for controlling a driving circuit to keep the transducer vibrating at its natural resonance frequency.

Some embodiments of the invention monitor the peak velocity (rather than displacement) of a driven electro-mechanical acoustic transducer, process the monitored peak velocity signal to generate a feedback signal indicative of actual radiated energy from the moving transducer, and generate from the feedback signal one or both of a control signal for driving the transducer in a desired manner and a warning signal indicating that the transducer has not radiated a selected minimum amount of energy.

DESCRIPTION OF THE PREFERRED EMBODIMENTS

A first embodiment of the invention will be described with reference to FIG. 1. The system of FIG. 1 includes an electro-mechanical acoustic transducer 2, and circuitry for driving transducer at its natural resonance frequency. In preferred embodiments, transducer 2 is a vehicle alarm (a loudspeaker having a conventional voice coil, mounted in or on a vehicle). An example of such a loudspeaker is that shown in FIG. 2 (to be described below).

Figure 1:
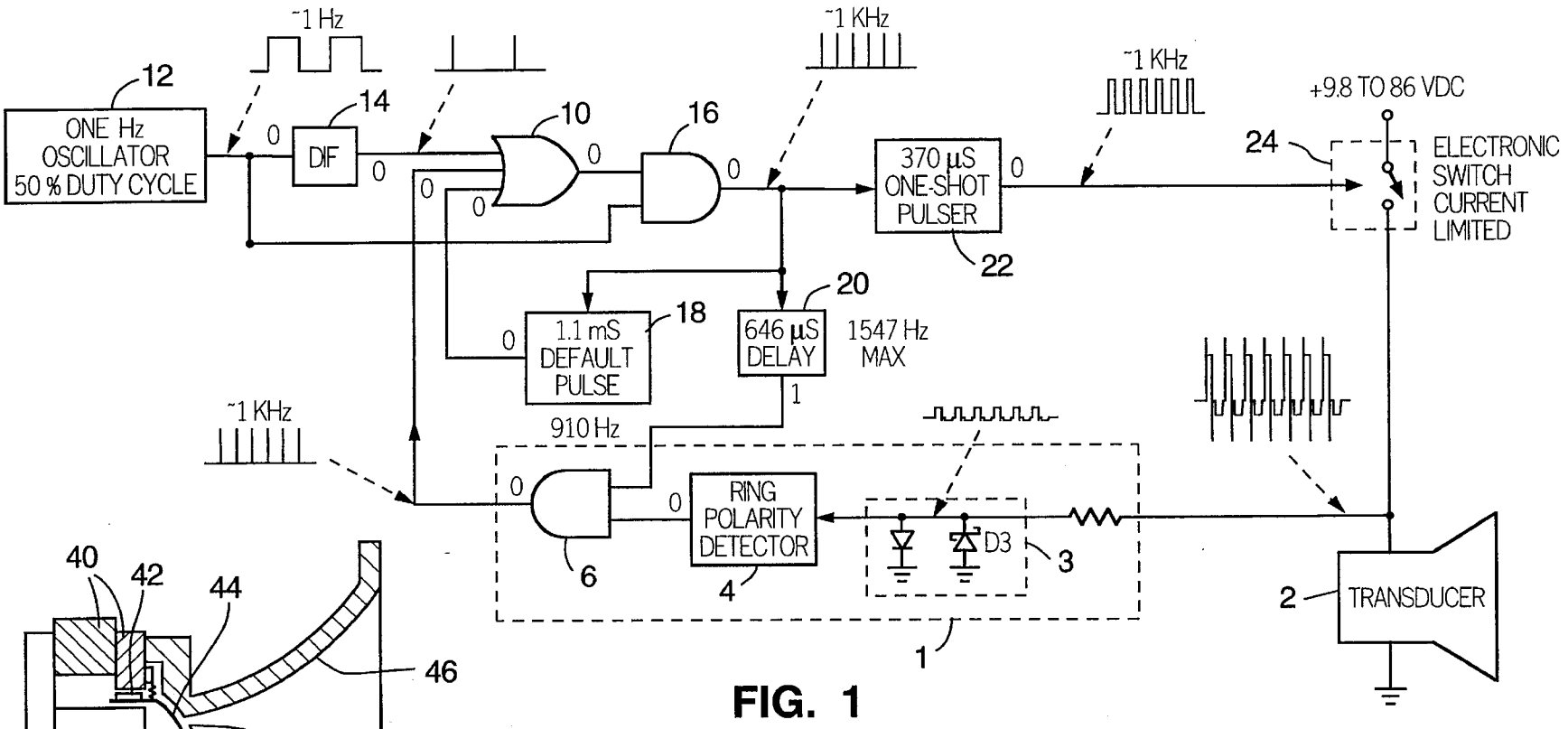
FIG. 1 is a block diagram of a system embodying the invention.

In the system of FIG. 1, high-impedance detector circuit 1 monitors the motion of transducer 2. Transducer 2 is connected in series between ground and current limited electronic switch 24. In response to each voltage pulse from one-shot pulser circuit 22, switch 24 closes, thereby applying voltage (typically in the range from 9.8 to 86 volts as indicated in FIG. 1, which is substantially higher than the amplitude of each of the voltage pulses output from circuit 22) across transducer 2 (thereby moving transducer 2 away from its resting position). Then, at the end of each such pulse from one-shot pulser 22, transducer 2 begins to execute "ringing" vibration (with a fundamental frequency that matches its natural resonance frequency) and thus emits acoustic radiation. In response to an appropriately timed sequence of voltage pulses (preferably sharp-edged voltage pulses) from one-shot pulser 22, the current flowing through switch 24 (and transducer 2) causes transducer 2 to emit a substantially continuous sound signal.

Pulser 22 is designed to assert such voltage pulses to switch 24 at any frequency (determined by circuits 1, 10, and 16) within a range of frequencies that includes a nominal (assumed or expected) natural resonance frequency of transducer 2. The design of the inventive system thus assumes that transducer 2 has a natural resonance frequency within this range, but does not require prior knowledge of transducer 2's actual resonance frequency. The system is capable of driving transducer 2 at resonance even if transducer 2's natural resonance frequency varies with time (during operation of the system).

Figure 2:
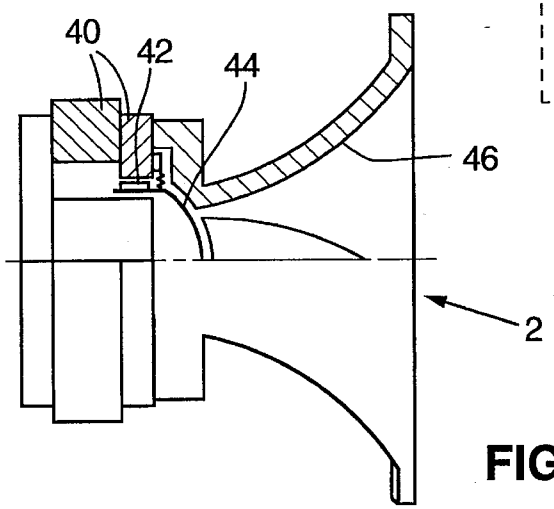
FIG. 2 is a cross-sectional view of a loudspeaker which can be employed as element 2 of the FIG. 1 system.

In preferred embodiments, transducer 2 is conventional loudspeaker of the type shown in FIG. 2. This loudspeaker includes permanent magnet assembly 40, voice coil 42, diaphragm 44 and horn enclosure 46. As voice coil 42 translates (to the left or right in FIG. 2) relative to fixed magnet assembly 40, coil 42 exerts force on diaphragm 44, causing diaphragm 44 to move in a manner so that acoustic waves are radiated away from diaphragm 44 (primarily through horn enclosure 46). In an embodiment of the type shown in FIG. 2, transducer 2 responds as follows to one of the voltage pulses from circuit 22: the voltage pulse turns on switch 24 for a period T (allowing a pulse of current to flow through the voice coil from switch 24 to ground during the period T), the moving portion of the transducer (e.g., the voice coil and diaphragm) moves (relative to the fixed magnet assembly) away from its rest position to a displaced position (as the current pulse flows through its voice coil), and then (at the end of period T) the moving portion of the transducer undergoes "ringing" vibration (thereby emitting acoustic radiation) with a fundamental frequency that matches its natural resonance frequency. During such ringing motion, current is induced in the voice coil as the moving portion of the transducer moves through the magnetic field of the fixed magnet assembly.

It is contemplated that in alternative embodiments, acoustic transducer 2 of FIG. 1 is a loudspeaker having a movable magnet assembly and a fixed voice coil. In such embodiments, the invention generates feedback indicative of the motion of the magnet assembly (and any other components which move as a unit with the moving magnet assembly), and controls a means for driving the transducer in response to such feedback to cause the driving means to drive the transducer at the actual natural resonance frequency of its moving portion.

We next describe the circuitry shown in FIG. 1, which drives transducer 2 at its natural resonance frequency. In FIG. 1, the reference number "1" or "0" next to a signal line indicates the logic level of the line during operation of the circuit with switch 24 open. The following description of FIG. 1 assumes that each voltage representing a logical "1" (e.g., each output pulse from circuit 22 which closes switch 24) has a relatively high voltage value, and each voltage representing a logical "0" has a relatively low voltage value. Of course, it is within the scope of the invention to employ circuitry implementing the same logical functions with signals having the opposite voltage polarities (and the FIG. 4 embodiment, to be described below, does so).

In accordance with the invention, the function of detector circuit 1 of FIG. 1 is to monitor the voltage across transducer 2's voice coil. Detector circuit 1 includes voltage limiting circuit 3 (including a Schotky diode connected to ground as shown), ring polarity detector 4, and AND gate 6.

Ring polarity detector 4 normally asserts a logical "0" signal at its output, but asserts a narrow (short time duration) pulse indicative of a logical "1" at its output each time the monitored voltage signal from transducer 2 undergoes a positive-going zero crossing (i.e., each time the instantaneous amplitude of the monitored voltage signal passes through zero during a transition from a negative to a positive voltage value).

Circuitry 3 is optionally connected as shown between ring polarity detector 4 and transducer 2, for the purpose of limiting the monitored voltage swings at the input of ring polarity (to ensure stable operation of ring polarity detector 4). In particular, Schotky diode D3 of circuit 3 is connected so as to prevent the voltage at the input of ring polarity detector circuit 4 from going so far below circuit common that the internal substrate diode (of an LM2901 open collector quad comparator within circuit 4, in the preferred embodiment to be described with reference to FIG. 4) becomes forward biased, causing instability of circuit 4 during critical timing periods.

The output of circuit 4 is supplied to one input of AND gate 6. The other input of AND gate 6 receives the output of delay circuit 20. The function of delay circuit 20 will be described in detail below. Briefly, the function of circuit 20 is to assert a logical "0" to AND gate 6 for a period of selected duration following assertion of each trigger pulse to the input of one-shot pulser 22. During assertion of each such logical "0" signal by delay circuit 20, circuit 1 is disabled (it is contemplated that there may be spurious zero crossings of the signal monitored by detector 4 during such period of selected duration after assertion of each trigger pulse to one-shot pulser 22).

AND gate 6 normally asserts a logical "0" signal at its output, but asserts a narrow (short time duration) pulse indicative of a logical "1" at its output each time both the following conditions are satisfied: the voltage signal monitored by detector 4 undergoes a positive-going zero crossing, and delay circuit 20 is not asserting a logical "0" signal to disable circuit 1.

Figure 4:
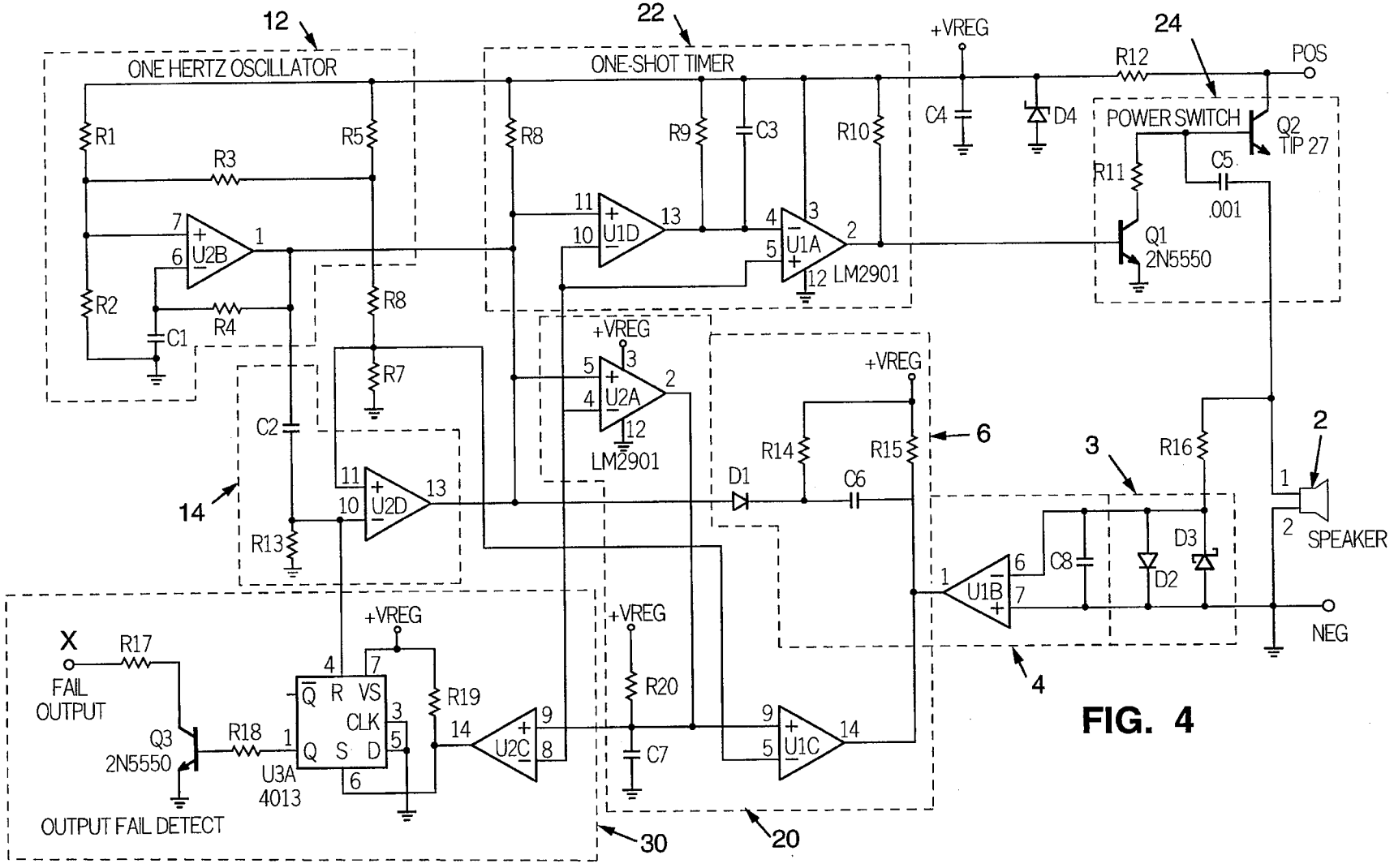
FIG. 4 is a schematic diagram of a system which is a preferred embodiment of the invention.

A preferred embodiment of each of circuits 3, 4, 6, and 20 (of FIG. 1) is shown in FIG. 4 (to be described below).

The FIG. 1 circuit also includes the following components (connected as shown in FIG. 1): oscillator circuit 12 (which outputs a square wave voltage whose rising edges occur at a frequency of about one Hertz), logic circuit 14 (which produces a narrow positive voltage pulse, representing a logical "1," in response to each rising edge of the square wave output of oscillator 12), OR gate 10, AND gate 16, default pulse generation circuit 18, delay circuit 20, and one-shot pulser 22.

The function of circuit 12 is as follows. The waveform of the square wave voltage output from oscillator circuit 12 determines an intermittent operation cycle of transducer 2 in the following sense: in response to "low" voltage output from circuit 12 (indicative of a logical "0"), transducer 2 is disabled (i.e., cannot emit sound); and in response to "high" voltage output from circuit 12 (indicative of a logical "1"), transducer 2 can emit sound. In typical vehicle alarm applications of the invention, the square wave output of oscillator 12 has a frequency of about 1 Hz (and transducer 2 is mounted in or on a vehicle), so that during normal operation transducer 2 is driven to emit bursts of sound (which may have frequency of about 1 KHz) at the burst rate of about one burst per second.

More specifically, the output of circuit 12 is provided to one input of AND gate 16. Assertion of a logical "1" (a narrow pulse of positive voltage) at the output of AND gate 16 triggers one-shot pulser 22 (in the sense that pulser 22 asserts a positive voltage pulse, of somewhat longer duration, in response to such a narrow voltage pulse from AND gate 16). Thus, one-shot pulser 22 is disabled during assertion of each logical "0" at the output of oscillator circuit 12 (and at an input of AND gate 16).

The function of logic circuit 14 is as follows. Circuit 14 receives the square wave output of circuit 12, and produces a narrow positive voltage pulse (representing a logical "1") in response to each rising edge of such square wave signal. The output of circuit 14 is supplied to one input of OR gate 10. The other two inputs of OR gate 10 receive, respectively, the output of AND gate 6 (of detector 1) and the output of default pulse generator 18. Thus, in the case that circuit 6 and 18 both assert logical "0" signals to OR gate 10 (i.e., neither asserts a positive voltage pulse to OR gate 10), the output of circuit 14 will nevertheless cause AND gate 16 to assert a positive voltage pulse (a logical "1") once per each oscillation cycle of oscillator circuit 12.

Circuits 12 and 14 are omitted in variations on the FIG. 1 apparatus which do not require intermittent acoustic output from transducer 2.

Default pulse generator 18 normally asserts a logical "0" at its output (i.e., when AND gate 16 asserts, to generator 18, a train of logical "1" pulses in response to a similar pulse train from AND gate 6). However, default pulse generator 18 asserts a train of logical "1" pulses at its output (at a rate of about 910 Hz, in preferred embodiments in which the natural frequency of transducer 2 is about 1 KHz) under the following condition: an initial pulse asserted by AND gate 16 (in response to a pulse from circuit 14) is not followed (during a predetermined time window) by a subsequent pulse assertion at the output of AND gate 16. In response to such a default pulse train from circuit 18, transducer will emit a "default" audio signal having a default frequency (i.e., 910 Hz, in the mentioned preferred embodiments). Such a default audio signal may be required to satisfy the requirements of the standard known as "SAE J994" of certain vehicle alarms. Since SAE J994 requires a minimum frequency of 700 Hz for vehicle back-up alarms, a 910 Hz default frequency is implemented in the mentioned preferred embodiments. Alternatively, circuit 18 can be designed to output a pulse train (under the described condition) having any other desired default frequency (or circuit 18 can be omitted in variations on the FIG. 1 apparatus which do not require a default audio output from transducer 2).

As mentioned, the output of circuit 14 is supplied to one input of OR gate 10, the output of AND gate 6 is supplied to a second input of OR gate 10, and the output of default pulse generator 18 is supplied to a second input of OR gate 10. Each time one of circuits 6, 14, and 18 asserts a short duration voltage pulse indicative of a logical "1" to OR gate 10 (but only when the output of oscillator 12 is a logical "1"), the output of both circuit 10 and circuit 16 is a short duration ("Ts") voltage pulse indicative of a logical "1." In response to each such voltage pulse (of duration Ts) at the output of circuit 16, one-shot pulser 22 asserts a voltage pulse (of somewhat longer duration "Tl," where "Tl" is substantially greater than Ts) also indicative of a logical "1," to cause switch 24 to close for (such duration T1).

Typically, the value of Ts is less than 5% of the value of T1. In designing the FIG. 1 circuit, the value of T1 should be chosen to be less than or equal to 90% of "Pn," where Pn=(1/Tn), where "Tn" is the expected natural resonant frequency of transducer 2. In a class of preferred embodiments, Tl=37%(Pn).

Figure 3:
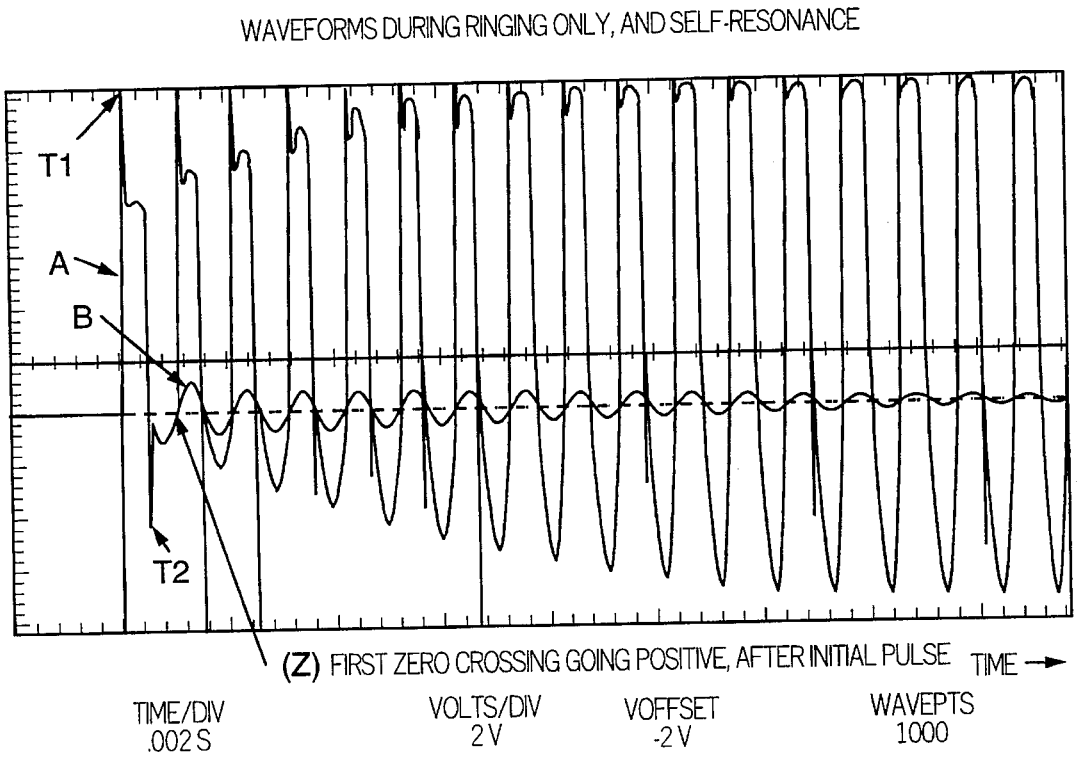
FIG. 3 is a graph showing waveforms of signals generated by the FIG. 1 system.

We next describe the manner of operation of FIG. 1, with reference to waveforms A and B shown in FIG. 3. Each of these waveforms represents voltage (as a function of time) across the voice coil of transducer 2 (in an embodiment in which transducer 2 is a loudspeaker having a voice coil of the type shown in FIG. 2). In FIG. 3, the vertical axis represents the potential difference between the end of the voice coil connected to switch 24 and the opposite end of the voice coil, and the horizontal axis represents time. Waveforms A and B coincide until time "Z" (the time of occurrence of the first positive-going zero crossing of waveform B).

Waveform B of FIG. 3 represents the voltage across the voice coil resulting from a single voltage pulse (of amplitude 14.5 volts) applied (from time T1 to time T2) between switch 24 and ground. The frequency of this sinusoidal "ringing" signal is the transducer's natural resonance frequency.

Waveform A of FIG. 3 represents the voltage across the voice coil resulting from the following driving signal: an initial voltage pulse (of amplitude 14.5 volts) applied (from time T1 to time T2) between switch 24 and ground, followed by a sequence of identical voltage pulses (each applied when the voice coil voltage (as monitored by detector 1) has a positive-going zero crossing. The first such positive-going zero crossing occurs at time Z. The initial voltage pulse is applied across transduced 2 in response to a rising edge of the square wave voltage signal asserted by oscillator circuit 12 to circuit 14 (which in turn results in assertion of a short-duration logical "1" signal from circuit 14 to OR gate 10). Each subsequent voltage pulse is applied in response to a short-duration logical "1" signal output from AND gate 6 (of detector 1) to OR gate 10, in response to a positive-going zero crossing detected by circuit 1. The width of the initial pulse and each subsequent pulse is the time difference $\Delta T = T1 - T1$ (which is determined by the width of one positive voltage pulse asserted by one-shot pulser 22 to switch 24).

Next, with reference to FIG. 4, we describe a preferred embodiment of the system of the invention. Those subsystems (elements) of the FIG. 4 system which correspond to elements of the FIG. 1 system are numbered identically to the corresponding elements of FIG. 1. The FIG. 4 embodiment differs from that of FIG. 1 primarily in that the FIG. 4 system: includes a circuit 30 for generating a warning signal (FAIL OUTPUT) at output pin X when no positive-going zero crossing of the monitored voice coil voltage is detected in a selected time window (indicating that transducer 2 is not vibrating at a frequency within a selected frequency range); and does not include a counterpart to default pulse generation circuit 18 of FIG. 1.

With reference to FIG. 4: each of circuits U1A, U1B, U1C, U1D, U2A, U2B, U2C, and U2D is an open collector quad comparator (such as a standard LM2901 or LM339 integrated circuit); D3 is a Schotky diode; each of circuits D1 and D2 is a diode selected from the set of 1N4448, 1N914, or similar standard diodes; D4 is a Zener diode; Q2 is a power darlington transistor; Q1 is a 2N5550 (or similar) transistor; Q3 is a 2N5560 (or similar) transistor; and circuit U3A is a flip-flop (a standard 4013 or similar flip-flop).

As shown in FIG. 4, pin 2 of transducer 2 is tied to Negative system power (ground). Transistor Q2 (within power switch circuit 24) functions as the main power switch between pin 1 of transducer 2 and Positive system power. Transistor Q2 is driven by transistor Q1 via resistor R11. Capacitor C5 slows the operation of Q2 as a switch, to minimize spurious high-frequency inductive spikes when Q2 is turned on or off by Q1. Resistor 11 limits the current flowing between Q1 and the base of Q2.

Schotky diode D3 and diode D2 (within voltage limiting circuit 3) and capacitor C8 (within ring polarity detector 4) limit the monitored voltage swings at the inputs of comparator U1B (of ring polarity detector 4). In particular, Schotky diode D3 is connected so as to prevent the voltage across C8 from going so far below circuit common that the internal substrate diode of comparator U1B becomes forward biased, causing instability of circuit 4 during critical timing periods.

Pin 1 of transducer 2 is connected through resistor R16 to pin 6 of comparator U1B (and one electrode of capacitor C8). Pin 2 of transducer 2 is connected to pin 7 of comparator U1B (and the other electrode of capacitor C8). U1B's output pin 1 (which is pulled up by resistor 15) remains high (i.e., remains at high voltage) as long as U1B pin 6 is negative with respect to U1B pin 7. U1B pin 1 goes low when U1B pin 6 is positive with respect to U1B pin 7. Later, we will explain the manner in which a high-to-low voltage transition at U1B pin 1 (caused by a positive-going zero crossing of the voltage across transducer 2's voice coil) results in a short duration negative-going voltage pulse at input pin 11 of comparator U1D (within one-shot timer 22).

Next, we describe oscillator circuit 12 of FIG. 4 (which comprises comparator U2B, resistors R1–R5, and capacitor C1 connected as shown). The voltage on output pin 1 of U2B has a square-wave waveform (with a 1 Hz frequency). When U2B pin 1 is low, transducer 2 emits no sound. When U2B pin 1 is high, transducer 2 is driven to emit a sound having frequency matching its natural resonance frequency (typically about 1 KHz).

Upon application of voltage across the Positive and Negative terminals (shown at the right side of FIG. 4), the potential at U2B pin 6 is below that at U2B pin 7 (since C1 is discharged at this time), and so U2B pin 1 is pulled high by resistor R5. C1 then charges through R4 until the voltage at U2B pin 6 exceeds that at U2B pin 7. At this time, U2B pin 1 goes low, pulling U2B pin 7 even lower than before (via R3). Then, C1 discharges through R4 until the voltage at U2B pin 6 is below that at U2B pin 7, at which time U2B pin 1 switches high again. This cycle repeats indefinitely until power is removed from the Positive and Negative terminals.

We next describe one-shot pulser circuit 22 (which comprises comparators U1A and U1D, resistors R8, R9, and R10, and capacitor C3 connected as shown). Circuit 22 functions as follows. As long as the voltage at U1D pin 11 (pulled high by R8) is above the voltage at U1D pin 10, U1D's output pin 13 is high. As long as the voltage at U1A pin 4 is above the voltage at U1A pin 5, U1A's output pin 2 is low (thereby switching off Q1 and Q2 so that no current flows through transducer 2).

When a low voltage pulse is applied to U1D pin 11 (either via D1 of AND gate 6, or via U2D pin 13 of circuit 14) to pull U1D pin 1t below U1D pin 10, U1D's output pin 13 goes low, thereby quickly charging C3 and driving U1A pin 4 low. This results in U1A's output pin 2 to be switched high (as pulled up by R10), thereby switching on Q1 and Q2 to apply current to transducer 2. When U1D pin 11 returns high again (at the end of the incoming low pulse), U1D again changes state so that U1D pin 13 is no longer held low. In this state, as C3 discharges (through R9) sufficiently so that U1A pin 4 rises above U1A pin 5, U1A again switches its output pin 2 low (again turning off Q1 and Q2).

The incoming low voltage pulse (negative-going voltage pulse) applied to U1D pin 11 (either from D1 of AND gate 6, or U2D pin 13 of circuit 14) has duration less than 5% of that of the positive-going pulse it causes at U1A's output pin 2.

One-shot pulser 22 is disabled (i.e., prevented from being triggered by an incoming negative-going voltage pulse applied to U1D pin 11) when U2B pin 1 drives U1D pin 10 and U1A pin 5 low. As explained above, this disabled state occurs with a 50% duty cycle at a frequency of 1 Hz (due to the square-wave nature of the voltage on U2B pin 1).

We next describe the two events that cause application of an incoming negative-going voltage pulse to U1D pin 11 (namely, a low voltage pulse at U2D pin 13, or a low voltage pulse at diode D1).

Such a negative-going voltage pulse is asserted by U2D pin 13 each time the output of U2B goes high (as explained, this occurs with a frequency of 1 Hz, due to the square-wave nature of the voltage on U2B pin 1). Conceptually, such a pulse is necessary to cause an initial current pulse through transducer 2 (thereby initiating ringing motion of transducer 2 which can be monitored by ring polarity 4). Specifically, a negative-going voltage pulse at U2D pin 13 is generated as follows:

when the voltage of output pin 1 of U2B goes high, this low-to-high transition is coupled to U2D pin 10 via capacitor C2 (thus raising the voltage on U2D pin 10 above that on U2D pin 11, which causes U2D's output pin 13 to go low); and then, as C2 charges via R13, the voltage at U2D pin 10 gradually falls until it drops below that on U2D pin 11, at which time U2D switches again (U2D pin 13 is pulled high by R8).

A negative-going voltage pulse is asserted by D1 (of AND circuit 6) on U1D pin 11 in response to each high-to-low voltage transition at U1B pin 1 of detector 4, but only if such transition at U1B pin 1 occurs in response to a positive-going zero crossing of the voltage across transducer 2's voice coil that occurs within a time window (determined by delay circuit 20, to be described below). After Q2 is switched off for the first time (after U2B pin 1 goes high for the first time in each 1 Hz cycle of circuit 12), a first high-to-low transition occurs at U1B pin 1 in response the first positive-going zero crossing of the voltage across transducer 2. This first high-to-low transition is transferred via C6 and D1 to U1D pin 11 (to trigger one-shot pulser 22). When this occurs, C6 quickly charges via R14, thereby terminating a negative-going pulse at U1D pin 11 (the values of C6 and R14 are chosen so that the duration of the negative-going pulse at U1D pin 11 is less than 5% of the desired duration of the positive-going pulse to Q1 generated in response to such negative-going pulse at U1D pin 11).

Delay circuit 20 of FIG. 4 (comprising comparators U2A and U1C, resistor R20, and capacitor C7 connected as shown) establishes the "time window" mentioned in the previous paragraph as follows. The inputs of U2A are connected identically to those of above-described U1D, so that the outputs of U2A and U1D are identical. However, the signal asserted on the output pin 2 of U2A is provided to pin 9 of U1C (of delay circuit 20) and to pin 9 of U2C (of circuit 30), and functions as a reset for both U1C and U2C.

Output pin 14 of U1C (of delay circuit 20) goes low when U2A's output pin 2 drives U1C pin 9 lower than U1C pin 8. This occurs at times coinciding with each time that U1D causes U1A (of one-shot pulser 22) to turn on Q1 and Q2. As long as output pin 14 of U1C is low, output pin 1 of U1B is held low as well, thus preventing U1B from being able to assert a high-to-low transition through C6 and D1 into one-shot pulser 22 (as described above). This establishes a timed delay during which U1B cannot cause Q2 to be turned on again (in response to a monitored spurious noise spike from transducer 2). This delay period ends under the following circumstances.

After U2A pin 2 drives U1C pin 9 lower than U1C pin 8, C7 immediately begins to charge via R20. When C7 has charged sufficiently so that the voltage on U1C pin 9 is greater than that on U1C pin 8, the output of U1C turns off, allowing R15 to pull up the voltage at U1C's output pin 14 (as C6 discharges through R14 and R15). After C6 has discharged, U1C no longer holds U1B's output pin 1 low, and U1B is free to assert a high-to-low transition through C6 and D1 to U1D of one-shot pulser 22. Thus, the circuit determines a "window" of time ("delay" time) between the time at which U2A output pin 2 drives U1C pin 9 lower than U1C pin 8 (to cause U1C pin 14 to hold U1B pin 1 low), and the time at which C7, C6, R20, R14, and R15 have caused U1C output pin 14 to be pulled high (so that U1B pin 1 is free to assert a high-to-low transition through D1 to one-shot pulser 22). The components of circuits 6 and 20 (of FIG. 4) are selected so that this window of time is less than the expected natural resonance period (i.e., the inverse of the expected natural resonance frequency) of transducer 2, but greater than the period in which spurious noise spikes from transducer 2 are expected (immediately after turn-off of transistor Q2). In the preferred embodiment of FIG. 4 (and FIG. 1), the "window" of time is 646 microseconds.

Warning signal generation circuit 30 of FIG. 4 (comprising flip-flip U3A, comparator U2C, resistors R17, R18, and R19, and transistor Q3 connected as shown) operates as follows to generate above-mentioned warning signal (FAIL OUTPUT) at output pin X.

Output pin 14 of U2C goes low when U2A's output pin 2 drives U2C pin 9 lower than U2C pin 8. This occurs at times coinciding with each time that U1D causes U1A (of one-shot pulser 22) to turn on Q1 and Q2. After U2A pin 2 drives U2C pin 9 lower than U2C pin 8, C7 immediately begins to charge via R20. When C7 has charged sufficiently so that the voltage on U2C pin 9 is greater than that on U2C pin 8, output pin 14 of U2C is switched off. Such transition at output pin 14 of U2C always occurs later than the above-described (low-to-off) transition at output pin 14 of U1C, because the trip voltage for U2C is set by the voltage at U2B output pin 1 (of oscillator 12) which is always higher than the voltage at the junction of R6 and R7, which latter voltage is the trip voltage for U1C. Thus, a low-to-off transition at output pin 14 of U2C will not occur if U2A's output pin 2 drives U2C pin 9 lower than U2C pin 8 (i.e., if U1D causes U1A to turn on Q1 and Q2) during the following window of time: the window in which C7 charges from the voltage at the junction of R6 and R7 to the voltage at output pin 14 of U1C (the junction of R5 and R6). If a negative-going pulse is asserted at U1B output pin 1 during this window (which in turn causes U1D to cause U1A to turn on Q1 and Q2), then U2C is reset (and U1C is also reset) and the window timing function is repeated.

On the other hand, if no negative-going pulse is asserted at U1B output pin 1 during this window, then the voltage on U2C pin 9 is allowed to rise above that on U2C pin 8. When the voltage on U2C pin 9 is greater than that on U2C pin 8, output pin 14 of U2C is switched off, allowing R19 to pull U3A pin 6 high, thus setting the U3A flip-flop via its pin 6. The "Q" output of U3A (U3A pin 1) then goes high, turning on transistor Q3 via R18. When Q3 turns on, it sinks current from an external source into output terminal X through R17. This current signal (denoted as "FAIL OUTPUT" in FIG. 4) is a warning signal which can be interpreted by a remote indicating device as an indication that transducer 2 has failed (is not operating properly, in the sense that it is not vibrating at a frequency within a selected frequency range corresponding to the time window). Flip-flop U3A is reset every time output pin 1 of U2B (of oscillator 12) initially goes high (which occurs at a rate of 1 Hz), thus causing transfer of a positive-going reset pulse into U3A pin 4 via capacitor C2.

The "FAIL OUTPUT" signal (or other warning signal generated in accordance with the invention) can be employed to notify the system operator (e.g., the driver of a vehicle in which the FIG. 4 system is installed) that transducer 2 is not vibrating at its natural resonance frequency, or it can be employed to directly control other systems (such as the brakes or engine of a vehicle) to prevent unsafe operation.

In a class of alternative embodiments, the invention monitors the peak velocity of the moving portion of a driven electro-mechanical transducer (rather than, or in addition to, the displacement of such moving portion). The monitored peak velocity signal is then processed to generate one or both of a feedback signal indicative of actual energy stored in the transducer, and a feedback signal indicative of the actual energy of the acoustic radiation radiated away from the transducer. In accordance with the invention, the latter type of feedback signal is processed to generate one or both of: a control signal for driving the transducer in a desired manner; and a warning signal indicating that the transducer has not radiated a selected minimum amount of energy. Such a control signal can be employed to modify the waveform of the driving signal applied to the transducer, for example to cause the transducer to radiate a selected amount of energy (without knowledge of the characteristics of the components used in the manufacture of the transducer). Such a warning signal can be employed to notify the system operator (e.g., the driver of a vehicle in which the inventive system is installed) that the transducer is not outputting the required amount of energy, or it can be employed to directly control other systems (such as the brakes or engine of a vehicle) to prevent unsafe operation.

Figure 5:
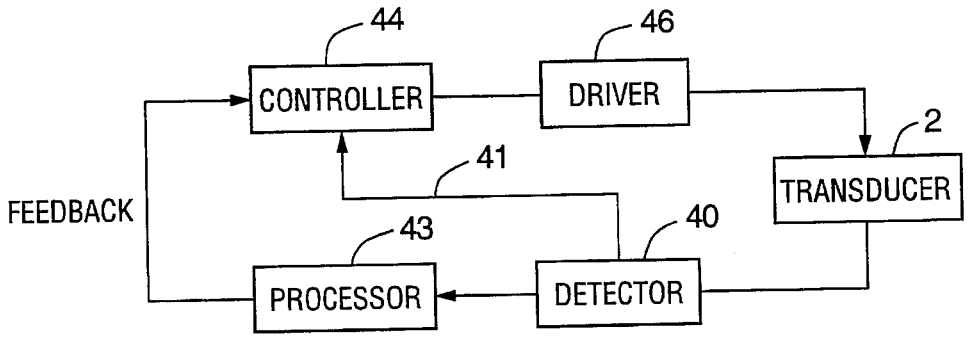
FIG. 5 is a block diagram of a system embodying the invention.

FIG. 5 is a block diagram of a system embodying the invention. Detector 40 monitors the peak velocity of the moving portion of electro-mechanical acoustic transducer 2 (and optionally also monitors the displacement of such moving portion). The monitored peak velocity signal 43 is then processed in processor 42 to generate a feedback signal indicative of the actual energy of the acoustic radiation radiated away from transducer 2, and this feedback signal is supplied to controller 44. Generation of this feedback signal in processor 42 (which can be a programmed computer) requires that processor 42 be programmed with the value of the radiation impedance of the medium through which the radiation propagates away from transducer 2.

The feedback signal output from processor 42 is processed by controller 44 to generate one or both of: a control signal for causing driver 46 to drive transducer 2 in a desired manner; and a warning signal indicating that transducer 2 has not radiated a selected minimum amount of energy. Such a control signal can be employed to cause driver 46 to modify the waveform of the driving signal applied to transducer 2, to cause transducer 2 to radiate a selected amount of energy. Such a warning signal can be employed to notify the system operator (e.g., the driver of a vehicle in which the inventive system is installed) that transducer 2 is not outputting the required amount of energy, or it can be employed to directly control other systems (such as the brakes or engine of a vehicle).

Optionally, a monitored displacement signal 41 is supplied as feedback directly from detector 40 to controller 44. This feedback signal is processed by controller 44 to generate a control signal which is supplied to driver 46 to cause driver 46 to drive transducer 2 at its actual natural resonance frequency (e.g., as one-shot pulser 22 and switch 24 of FIG. 1 drive transducer 2 of FIG. 1 at its actual natural resonance frequency).

Various modifications and alterations in the structure and method of operation of this invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. An acoustic transducer system, including:

an electro-mechanical acoustic transducer, having a movable portion, wherein the transducer is a voice coil loudspeaker, and the movable portion of the transducer includes a voice coil;

driving means for driving the transducer at any selected frequency within a range of frequencies including a nominal natural resonance frequency of said transducer;

detector means, coupled to the transducer, for generating a feedback signal indicative of actual natural resonance frequency of the movable portion of the transducer; and control means for receiving the feedback signal, and controlling the driving means in response to the feedback signal to cause said driving means to drive the transducer at said actual natural resonance frequency, wherein the driving means includes means for applying a sequence of voltage pulses across the transducer, wherein the detector means is a high-impedance detector circuit connected across the voice coil, and wherein the feedback signal is indicative of a zero crossing of voltage across the voice coil following application of each of said pulses.

2. The system of claim 1, wherein the driving means includes means for applying a sequence of voltage pulses across the transducer, and wherein the feedback signal is indicative of the actual natural resonance frequency of ringing motion of the movable portion of the transducer in response to each of said pulses.

3. The system of claim 1, wherein each of said pulses is a positive voltage pulse, and wherein said zero crossing is a positive-going zero crossing of voltage across the voice coil following application of each of said pulses.

4. The system of claim 3, wherein the detector means includes a delay means for causing said feedback signal to be indicative of a first positive-going zero crossing of voltage across the voice coil after a predetermined window of time after application of each of said pulses.

5. The system of claim 1, wherein the movable portion of the transducer includes a movable magnet assembly.

6. An acoustic transducer system, including:

an electro-mechanical acoustic transducer, having a movable portion;

driving means for driving the transducer at any selected frequency within a range of frequencies including a nominal natural resonance frequency of said transducer;

detector means, coupled to the transducer, for generating a feedback signal indicative of actual natural resonance frequency of the movable portion of the transducer; and control means for receiving the feedback signal, and controlling the driving means in response to the feedback signal to cause said driving means to drive the transducer at said actual natural resonance frequency, wherein the driving means includes:

a switch means connected to the transducer; and a one-shot pulser circuit having an output terminal connected to the switch means, wherein said one-shot pulser circuit includes means for applying a sequence of relatively low power voltage pulses to the switch means to cause said switch means to applying a sequence of relatively high power voltage pulses across the transducer.

7. An acoustic transducer system, including:

an electro-mechanical acoustic transducer, having a movable portion;

driving means for driving the transducer at any selected frequency within a range of frequencies including a nominal natural resonance frequency of said transducer;

detector means, coupled to the transducer, for generating a feedback signal indicative of actual natural resonance frequency of the movable portion of the transducer control means for receiving the feedback signal, and controlling the driving means in response to the feedback signal to cause said driving means to drive the transducer at said actual natural resonance frequency; and warning signal generation means for generating a warning signal indicating that the transducer is not vibrating at a frequency within a second selected range of frequencies.

8. A method for operating an electro-mechanical acoustic transducer having a movable portion, including the steps of:

(a) initiating ringing motion of the transducer;

(b) generating a feedback signal indicative of actual natural resonance frequency of the movable portion of the transducer during said ringing motion; and (c) controlling a driving means coupled to the transducer in response to the feedback signal to cause said driving means to drive the transducer at said actual natural resonance frequency, wherein the transducer is a voice coil loudspeaker and said movable portion of the transducer includes a voice coil, wherein step (c) includes the step of applying a sequence of voltage pulses across the transducer, and wherein the feedback signal is indicative of a zero crossing of voltage across the voice coil following application of each of said pulses.

9. The method of claim 8, wherein step (c) includes the step of applying a sequence of voltage pulses from the driving means across the transducer, and wherein the feedback signal is indicative of the actual natural resonance frequency of the movable portion of the transducer in response to each of said voltage pulses.

10. The method of claim 8, wherein each of said pulses is a positive voltage pulse, and wherein said zero crossing is a positive-going zero crossing of voltage across the voice coil following application of each of said pulses.

11. The method of claim 10, wherein step (b) includes the step of causing said feedback signal to be indicative of a first positive-going zero crossing of voltage across the voice coil after a predetermined window of time after application of each of said pulses.

12. A method for operating an electro-mechanical acoustic transducer having a movable portion, including the steps of:

initiating ringing motion of the transducer;

generating a feedback signal indicative of actual natural resonance frequency of the movable portion of the transducer during said ringing motion; controlling a driving means coupled to the transducer in response to the feedback signal to cause said driving means to drive the transducer at said actual natural resonance frequency; and processing the feedback signal to generate a warning signal indicating that the transducer is not vibrating at a frequency within a selected range of frequencies.

13. An acoustic transducer system, including:

an electro-mechanical acoustic transducer, having a movable portion;

driving means for driving the transducer at any selected frequency within a range of frequencies including a nominal natural resonance frequency of said transducer;

detector means, coupled to the transducer, for generating a peak velocity signal indicative of peak velocity of the movable portion of the transducer; and means for processing the peak velocity signal to generate a feedback signal indicative of actual radiated energy from the transducer.

14. The system of claim 13, also including:

warning signal generation means for processing the feedback signal to generate a warning signal indicating that the transducer has not radiated a selected minimum amount of energy.

15. The system of claim 13, also including:

control means for receiving the feedback signal, and controlling the driving means in response to the feedback signal to cause said driving means to drive the transducer in a desired manner.

16. An acoustic transducer system including:

an electro-mechanical acoustic transducer, having a movable portion, wherein the transducer is a voice coil loudspeaker, and said movable portion of the transducer includes a voice coil;

driving means for initiating ringing motion of the transducer;

detector means, of coupled to the transducer, for generating a feedback signal indicative of displacement of the movable portion of the transducer during said ringing motion; and control means for receiving the feedback signal, and controlling the driving means in response to the feedback signal to cause said driving means to drive the transducer at said actual natural resonance frequency, wherein the driving means includes means for applying a sequence of voltage pulses across the transducer, wherein the detector means is a high-impedance detector circuit connected across the voice coil, and wherein the feedback signal is indicative of a zero crossing of voltage across the voice coil following application of each of said pulses.

17. The system of claim 16, wherein each of said pulses is a positive voltage pulse, and wherein said zero crossing is a positive-going zero crossing of voltage across the voice coil following application of each of said pulses.

18. An acoustic transducer system, including:

an electro-mechanical acoustic transducer, having a movable portion;

driving means for initiating ringing motion of the transducer;

detector means, coupled to the transducer, for generating a feedback signal indicative of displacement of the movable portion of the transducer during said ringing motion;

control means for receiving the feedback signal and controlling the driving means in response to the feedback signal to cause said driving means to drive the transducer at said actual natural resonance frequency; and warning signal generation means for processing the feedback signal to generate a warning signal indicating that the transducer is not vibrating at a frequency within a selected range of frequencies.

* * * * *